US007673626B1

(12) United States Patent
Hennings

(10) Patent No.: US 7,673,626 B1
(45) Date of Patent: Mar. 9, 2010

(54) ARCHERY BOW HAVING A SHOOTING FORCE GREATER THAN DRAWING FORCE

(76) Inventor: Johnnie Paul Hennings, 3212 Taylors Ridge Rd., Wake Forest, NC (US) 27587

( * ) Notice: Subject to any disclaimer, the term of this patent is extended or adjusted under 35 U.S.C. 154(b) by 604 days.

(21) Appl. No.: 11/465,832

(22) Filed: Aug. 21, 2006

(51) Int. Cl.
*F41B 5/10* (2006.01)

(52) U.S. Cl. ..... 124/25.6; 124/900

(58) Field of Classification Search ..... 124/25.6, 124/900

See application file for complete search history.

(56) References Cited

U.S. PATENT DOCUMENTS

| | | | | |
|---|---|---|---|---|
| 3,962,927 | A | 6/1976 | Beaudoin et al. | |
| 3,978,741 | A | 9/1976 | Bettiol | |
| 4,028,953 | A | 6/1977 | Lavallee | |
| 4,060,066 | A | 11/1977 | Kudlacek | |
| 4,774,927 | A * | 10/1988 | Larson | 124/25.6 |
| 5,403,240 | A | 4/1995 | Smith et al. | |
| 5,709,624 | A | 1/1998 | Donowski | |
| 5,975,067 | A | 11/1999 | Strother | |
| 6,082,347 | A | 7/2000 | Darlington | |
| 6,250,293 | B1 | 6/2001 | Andrews | |
| RE37,544 | E | 2/2002 | Darlington | |
| 6,360,735 | B1 * | 3/2002 | Larson et al. | 124/25.6 |
| 6,516,790 | B1 | 2/2003 | Darlington | |
| 6,575,153 | B2 | 6/2003 | Lommasson et al. | |
| 6,656,068 | B2 | 12/2003 | Aitcin | |
| 6,666,202 | B1 | 12/2003 | Darlington | |
| 7,082,937 | B1 * | 8/2006 | Land | 124/25.6 |
| 2004/0074485 | A1 | 4/2004 | Cooper et al. | |

* cited by examiner

*Primary Examiner*—John Ricci

(57) ABSTRACT

A bow having a string trained around a string track of a cam wherein the configuration of the string track is variable with respect to the axis of the cam. In one configuration, the string track yields a mechanical advantage when the bowstring is pulled from an at rest position to a drawn position. When the bowstring is released from the drawn position, the string track assumes another configuration. The different configurations that the string track assumes results in the draw force, that is the force required to pull the string from the at rest position to the drawn position, being less than the shooting force, which is the force imparted to an arrow by the string when the string is released from the drawn position.

19 Claims, 13 Drawing Sheets

ARCHERY BOW HAVING A SHOOTING FORCE GREATER THAN DRAWING FORCE

FIELD OF THE INVENTION

The present invention relates to archery bows, and more particularly to an archery bow having a variable cam for engaging the bowstring of a bow.

BACKGROUND OF THE INVENTION

There are several types of archery bows and crossbows, that have been used over the years. Vertical bows and crossbows will be herein collectively referred to as "bows". Traditional vertical bows include long bows and recurves. These are typically made of only wood and have no mechanical parts. Compound bows, on the other hand, have eccentric wheels or camps that rotate as the bowstring is pulled to a shooting position. These bows typically have one or more cams or wheels that are attached to flexible limbs or the frame of the bow by an axle or pivot pin. A cam, when embodied within a bow, provides mechanical advantage for the shooter. When the bowstring is drawn, the flexible limbs will be stressed and store potential energy that will later be used to launch an arrow. The advantage of a compound bow over traditional bows is that when at full draw, less force is required to hold the bow than is required to draw it. This is called "let off" and typically varies from 50% to 85% of the peak draw force. Traditional bows require a steady increase in force to draw the bow to a full draw position. The advantage of "let off" is that the archer can remain at full draw for a long period of time and yet be able to control the bow.

The velocity of a bow is important because the faster the flight of the arrow, the flatter its trajectory and the less important is the estimation of range. Furthermore, arrows that possess high velocities will penetrate the target better. For hunters, this means the arrow is more likely to pass completely or substantially completely through the animal.

There are several ways for increasing the shooting velocity of a bow and arrow combination. The limitations are that most archers cannot draw more than 65-70 pounds, and youth and women typically cannot draw more than 45-50 pounds. Draw weight is the easiest method of increasing arrow speed, but is the most difficult on the shooter. Another approach is to increase the power stroke length of the bow. Power stroke is the distance of the draw from the at rest or braced position and the full draw position. This is approximately the draw length of the individual bow minus the brace height which is a perpendicular distance from the at rest position of the string to the riser. This is also easily changed. However, archers have size limitations that make it difficult to shoot a bow having a relatively large draw length. Also, the shorter the brace height, the more difficult it is to shoot the bow. Typical power strokes are limited to about 20 inches. Another way to increase bow velocity is to make the bow more efficient. This can be expensive and usually does not yield substantial benefits.

Yet another approach is to utilize lighter arrows. This is also an easy way of increasing arrow speed. The potential energy stored in the bow is transferred to kinetic energy of the arrow. The lighter the arrow, the faster it will travel when shot from the same bow. However, there are safety minimums on arrow weight that are based upon the shooting force of the bow. There is a lower limit to the arrow weight based upon the shooting force. If the bow is shooting arrows that are too light, much of the potential energy of the bow is absorbed by the bow as vibrations and stress, as opposed to being transferred to the arrow.

SUMMARY OF THE INVENTION

The present invention relates to a bow that is designed to yield a shooting force that is greater than the draw force. Expressed in another way, the present invention will enable an archer to draw a bow at a comfortable poundage and then have the bow shoot at a poundage higher than that required to draw the bow to the shooting position.

In one embodiment the present invention entails a bow comprising a frame (the frame includes all components of the bow assembly) and at least one variable cam secured to the frame. A string or cable is trained around at least a portion of the variable cam and adapted to be drawn and released. The variable cam includes a string engaging segment, or string track, that varies between at least two different configurations. The string track or the variable cam assumes one configuration when the string is being drawn and another configuration when the string is released and an arrow shot. The different configurations of the string engagement segment or string track results in the draw force being less than the shooting force.

The present invention also entails a method of reducing the draw force of the bowstring relative to the shooting force. This method entails engaging the bowstring with a cam having a variable string track that varies between at least two different configurations with respect to an axis of the cam. When the bowstring is drawn from an at rest position to a drawn position, the string track assumes a first configuration that yields a mechanical advantage. When the bowstring is released from the drawn position and moves towards the at rest position, the string track assumes a second configuration. The different configurations of the string track results in the draw force being less than the shooting force. This is a two stage process whereas the invention is "set" by drawing the string from the at rest position to the drawn position where the invention assumes the first configuration. At this time, the string can be released slowly down to the rest position at a reduced level of force. Subsequently, the string may be drawn and let down again at the reduced level of force as many times as necessary and will shoot the arrow at a force greater than required to draw.

Other objects and advantages of the present invention will become apparent and obvious from a study of the following description and the accompanying drawings, which are merely illustrative of such invention.

DESCRIPTION OF EXEMPLARY EMBODIMENT

Figure 1:
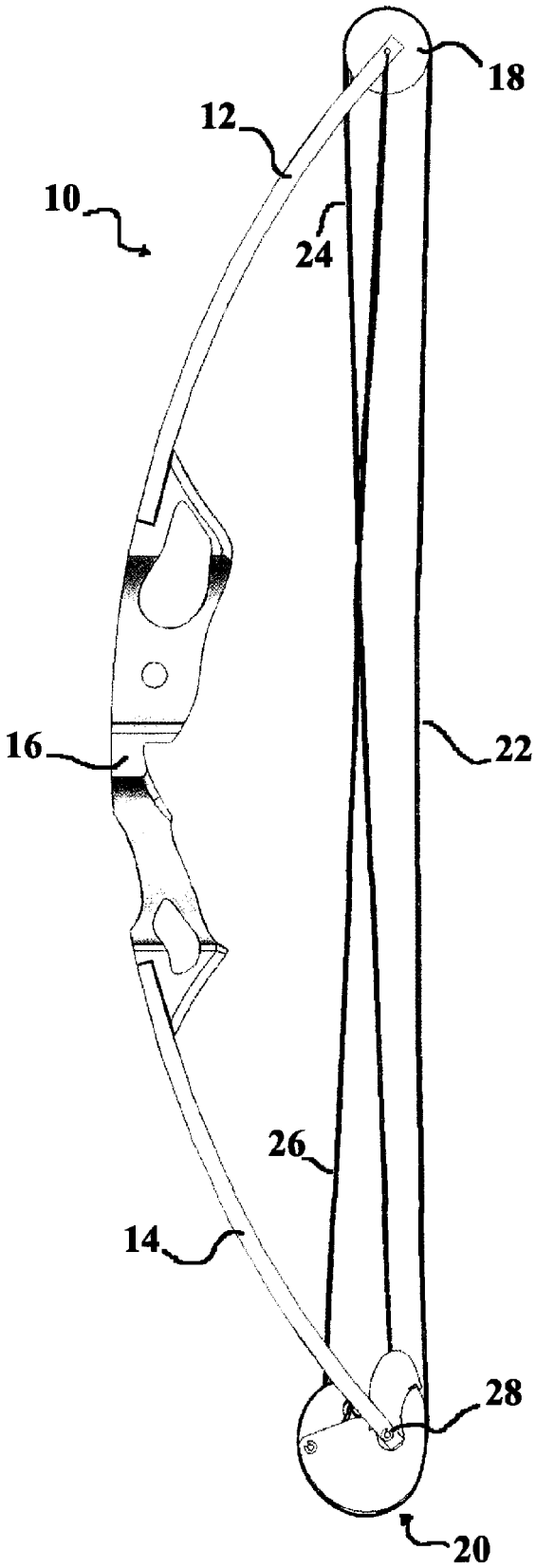
FIG. 1 is side elevational view of the present invention.

With further reference to the drawings, an archery bow is shown therein and indicated generally by the numeral 10 in FIG. 1. Archery bow 10 includes a frame that is made up of a riser 16, an upper limb 12 and a lower limb 14. In the case of this embodiment, the bow 10 is provided with an idler wheel or pulley 16 that is secured to one of the limbs 12 or 14.

Rotatively secured to the other limb is a cam or cam assembly indicated generally by the numeral 20. Details of the cam 20 will be subsequently discussed.

A bowstring 22 is trained around the idler wheel 18 and extends across the bow to where the string is connected to the cam 20. String herein means and includes a cable. A string cable 26 extends from the idler wheel or pulley 18 to where the same is anchored to the cam 20. A limb cable 24 is anchored, in this case, to the upper limb 12 and extends therefrom to where the limb cable is anchored to the cam 20.

Figure 2:
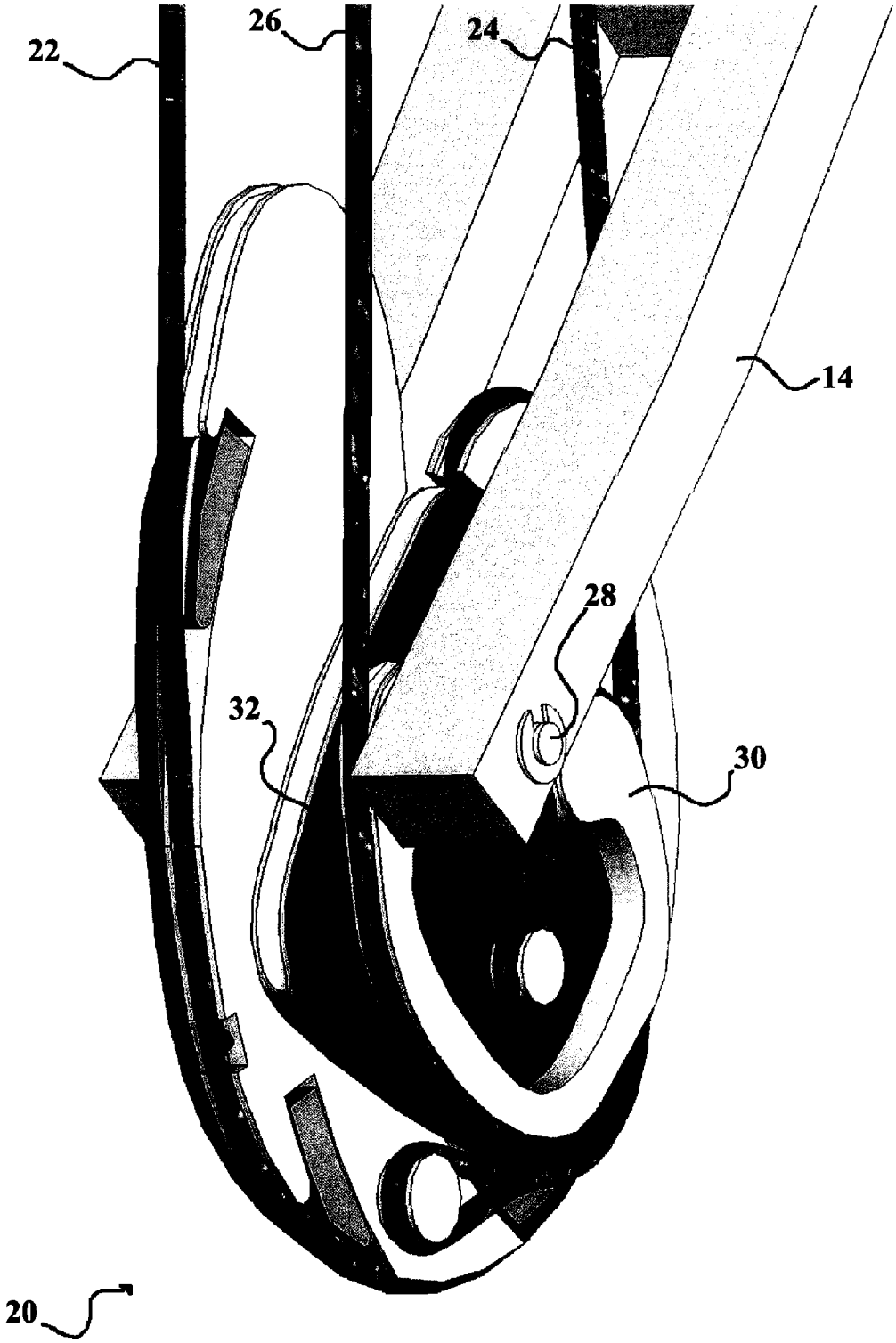
FIG. 2 is a perspective view of the rear side of the cam assembly of the bow.

Cam 20 is secured to the lower limb 14. It is appreciated that the positions of the idler wheel 18 and cam 20 could be reversed or mounted on another part of the bow. In any event, cam 20 is rotatively mounted to the lower limb 14 by an axle or pivot pin. Accordingly the cam 20 rotates about an axis 28. In conventional fashion, the cam or cam assembly 20 may include a series of individual cams for engaging the string cable and/or limb cable. In this case, cam 20 includes a string cable cam 30 and a limb cable cam 32 shown in FIG. 2. These cams engage and work in conjunction with the limb cable 24 and string cable 26.

Figure 3:
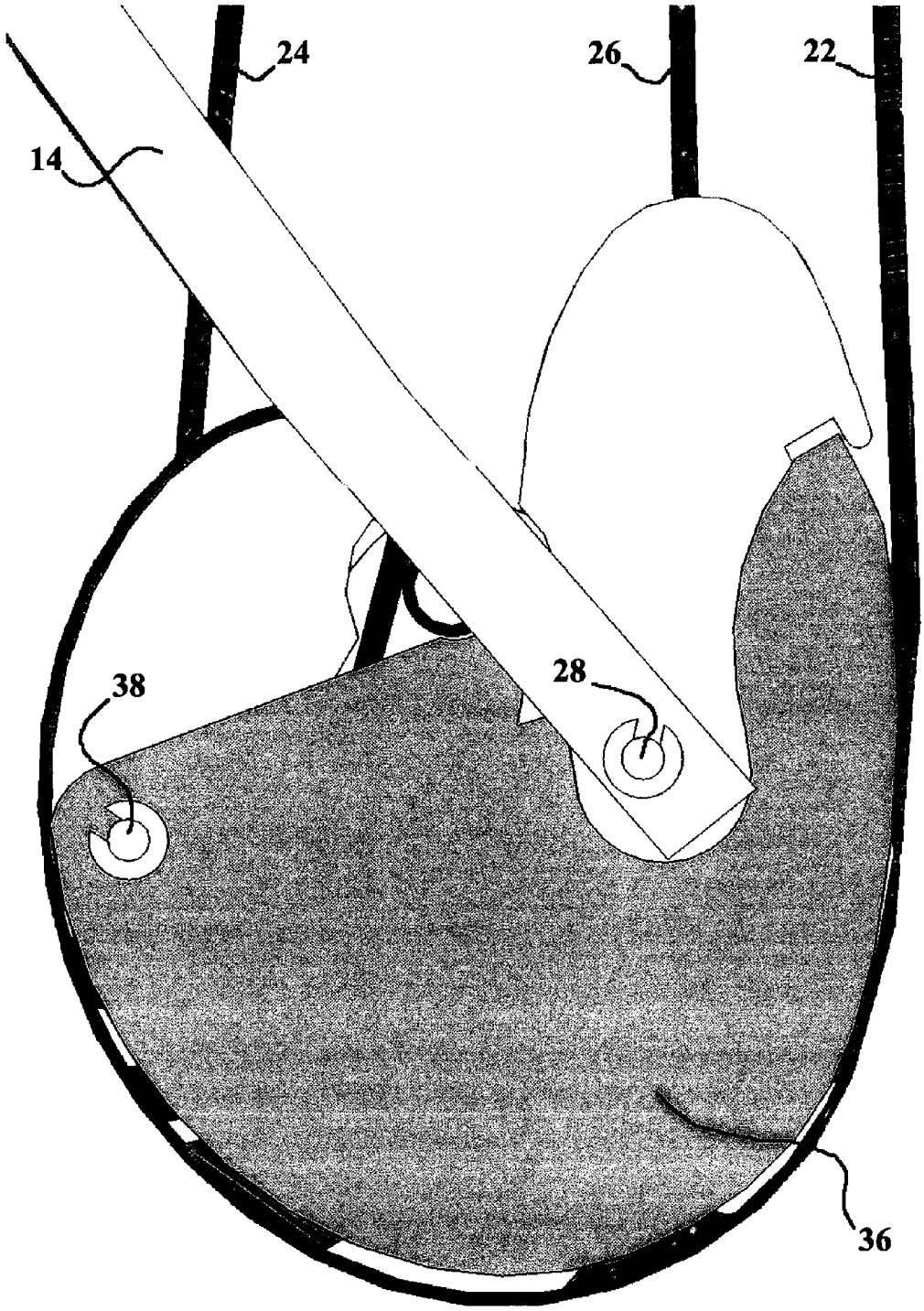
FIG. 3 is a side elevational view of the cam assembly in a first configuration and at rest.

Cam 20 is a variable cam because it includes a surface that is adapted to change configurations with respect to the axis 28 of the cam (FIG. 3). In this case, the cam 20 includes a cam surface for engaging the string 22. More particularly, the cam 20 includes a string track or string engaging segment that is movable with respect to the axis 28 of the cam between at least two different positions or configurations.

Figure 4:
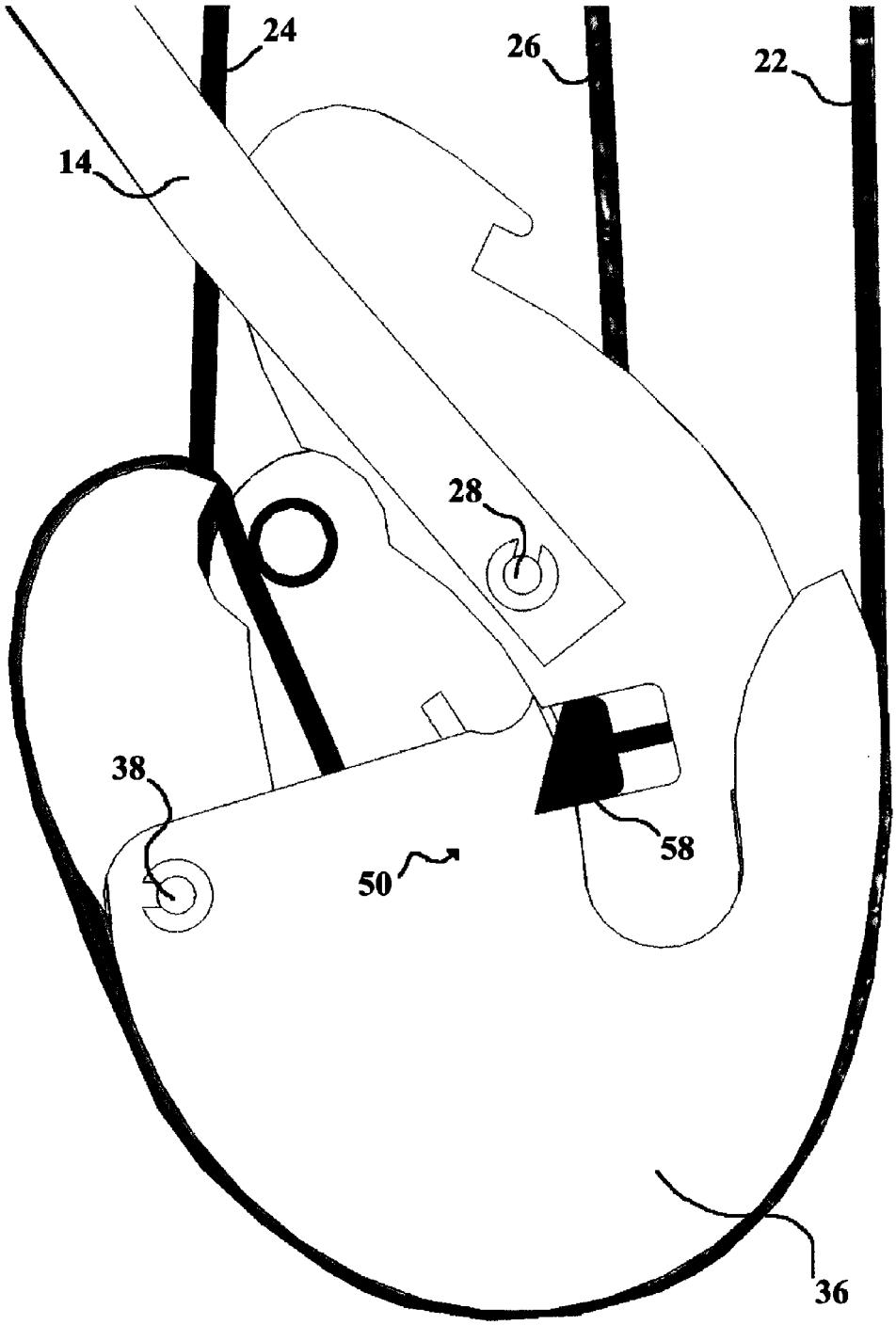
FIG. 4 is a side elevational view of the cam assembly and a second configuration and at rest.
Figure 5:
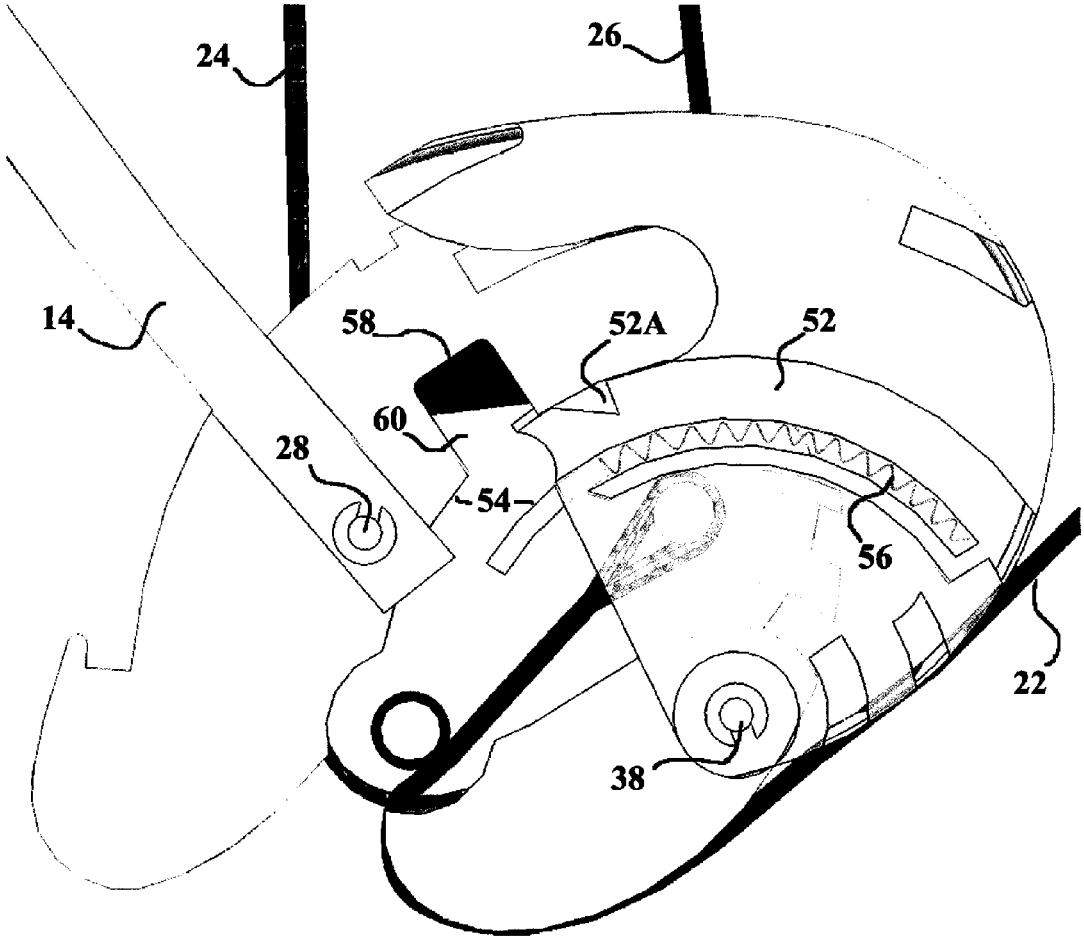
FIG. 5 is a side elevational view of the cam assembly at full draw with the outer face of the cam assembly being transparent to better illustrate adjacent structure.
Figure 6:
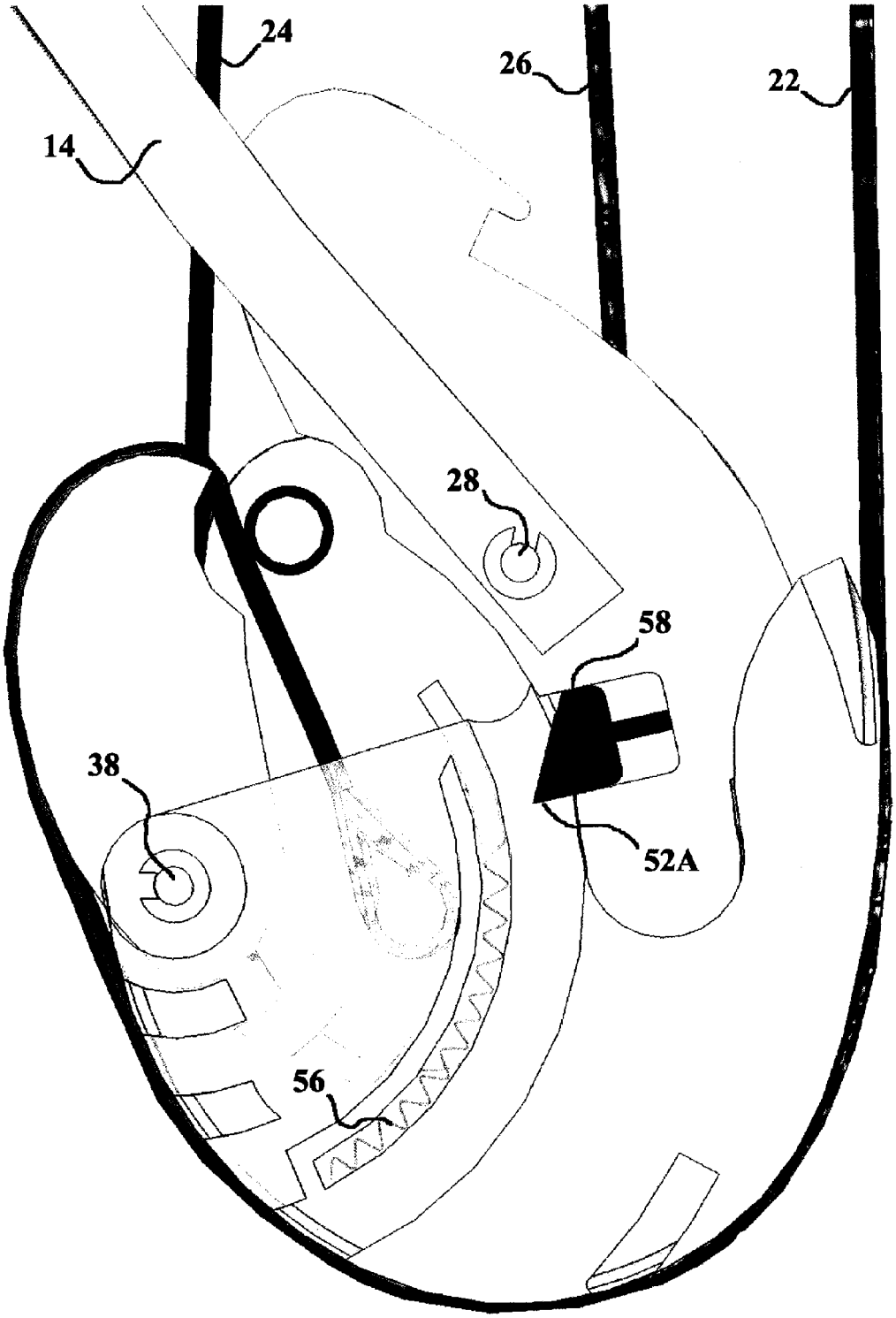
FIG. 6 is a side elevational view of the cam assembly and the second configuration and at rest and with an outer portion being shown transparent to better illustrate adjacent structure.

More particularly, the cam 20 includes a movable structure or member 36. Sometimes this movable structure or member is referred to as a lever 36. Lever 36 includes a pivot point or axis 38 and as seen in the drawings, may pivot between a first position, FIG. 3, and a second position, FIG. 4. At least a portion of the string track or string engaging segment of the cam 20 is disposed on the movable structure or lever 36. As will be appreciated from a typical operation of a bow, the string 26 normally assumes an at rest position. This is illustrated in FIG. 1, and in that position the string 22 extends generally straight across between the idler wheel pulley 18 and cam 20. In typical fashion, an arrow is engaged or held on the string 22 and the string is moved from the at rest position to a drawn position. The drawn position is shown in FIG. 5. Once the drawn position is reached, the user can release the string 22 and the string will exert what is termed a shooting force on the arrow. In moving the string 22 from the at rest position of FIG. 1 to the drawn position of FIG. 5, the operator must exert a force on the string. This is referred to as the draw force.

Turning to the cam 20 and the movable lever 36 associated therewith, the movable lever 36 normally assumes a first position as shown in FIG. 3. In this first position the lever 36 is engaged with an inner surface of the cam and the string track associated with the movable lever 36 is relatively close to the axis 28. String 22 is wrapped around the string track of cam 20 and lever 36. Lever 36 is movable from the first position to a second position. As seen in FIG. 4, lever 36 can be pivoted about axis 38 to the second position. In the second position the string track associated with the movable lever 36 is generally spaced further from the axis 28 of the cam than when the lever 36 assumes the first position. It is appreciated that the outer position of lever 36 causes a greater moment arm to be present with respect to the axis 28 due to the string being wrapped further from axis 28. When the lever 36 assumes its outer or second position, it is appreciated that the moment arm is longer than when the lever 36 assumes the inward or first position. Accordingly, a greater mechanical advantage is realized when the lever 36 assumes the second position.

Figure 7:
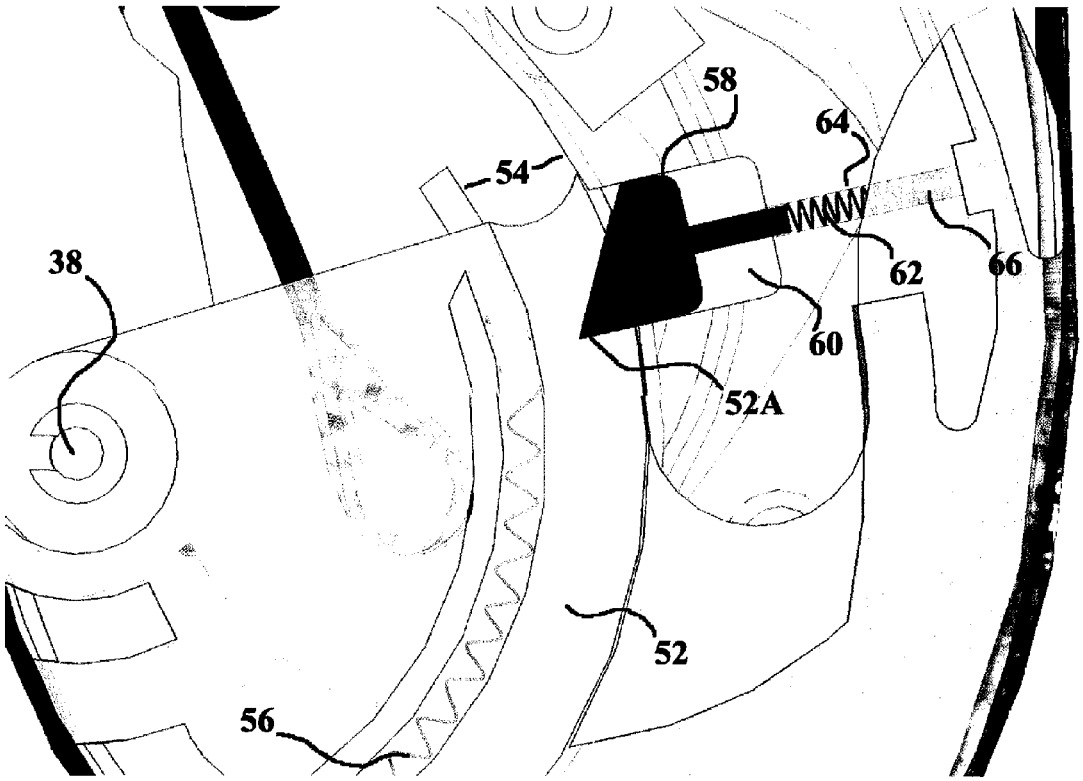
FIG. 7 is an enlarged elevational view showing the cam assembly in a locked position.

The bow 10 is provided with a locking mechanism 50 for maintaining the lever 36 in the second position and for selectively releasing the lever 36 in order that the lever may return to the first position. With further reference to FIGS. 4 and 7, the locking mechanism 50 is disposed on cam 20 and includes a locking arm 52. Locking arm 52 is secured to the lever 36 and in the embodiment illustrated herein, the locking arm 52 assumes a generally curved or arcuate configuration. Locking arm 52 is confined within a channel 54 formed in the cam 20. A coil spring 56 is seated within a portion of locking arm 52. Accordingly, spring 56 biases the locking arm 52 outwardly. Expressed in another way, spring 56 biases lever 36 towards (or past) the second position, shown in FIGS. 4 and 5.

Locking arm 52 includes a detent 52A. Extending from the channel 54 is a channel 60 and a spring hole 64. Channel 60 is communicatively open to channel 54. Disposed within channel 60 is a locking pin 58. A spring 62 is seated in spring hole 64 and interposed between a compression screw 66 and the exposed end of the locking pin 58. As viewed in FIG. 7, locking pin 58 is biased toward channel 54 by the spring 62.

Locking mechanism 50 assumes two positions, a locked position and an unlocked position. In the locked position shown in FIG. 7_, the locking mechanism 50 is operative to lock the lever 36 in the second position. In this position, a terminal end of locking pin 58 is biased downwardly into engagement with the detent 52A of the locking arm 52. This holds lever 36 in the second position. In the unlocked position, locking arm 52 clears locking pin 58 and extends past channel 60. The force or tension of the string 22 on the lever 36 causes the same to compress spring 56 such that the locking mechanism 50 normally assumes the unlocked position.

Figure 8:
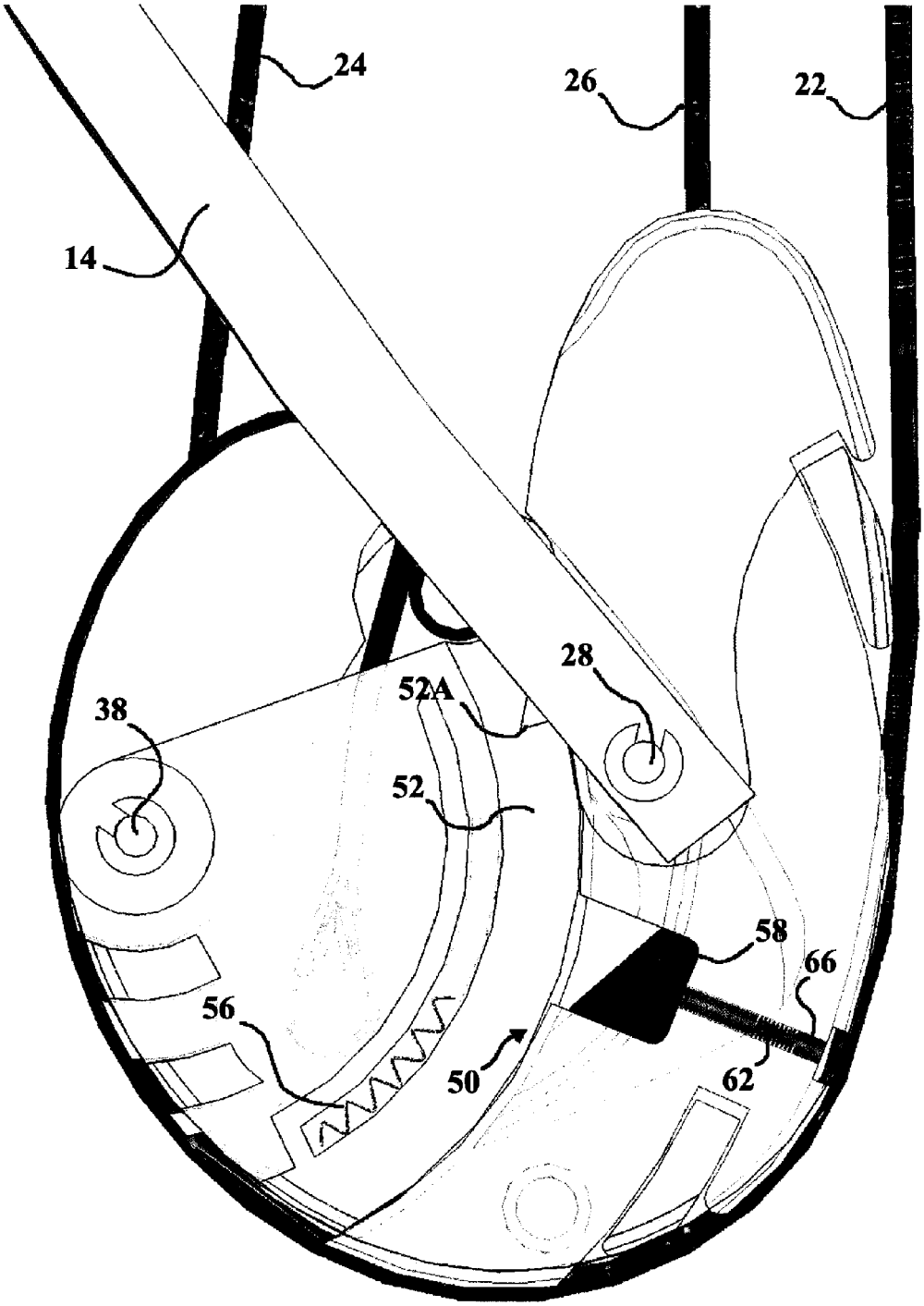
FIG. 8 is side elevational view of the cam assembly in the at rest position with the locking mechanism disengaged.

Therefore, as viewed in FIG. 8, when the string 22 is at the at rest position, the locking mechanism 50 is unlocked and the lever 36 assumes the first position. To set the lever 36 in the second position, the string 22 is pulled from the at rest position to the drawned position. By doing so the force or pressure that the string 22 exerts against the lever 36 is released and the spring 56 is operative to engage and push the locking arm 52 which will cause the lever 36 to rotate clockwise as viewed in FIG. 5 until the locking mechanism 50 is pushed past the engaged position and the lever 36 is in the fully extended position. Now the string can be slowly released back to the at rest position. As the string is slowly released to move from the drawned position to the at rest position, locking mechanism 50 will engage detent 52A and the lever 36 will remain locked in the second position. Now the bow is set and the lever 36 assumes the second position and because of the increase in the moment arm from the axis 28 of the cam to various points on the string track of the lever 36, the cam 20 is now configured to yield a substantial mechanical advantage when the user exerts a draw force on the string 22.

When the user exerts a draw force on the string 22 and pulls the string 22 to the drawn position, the string track around the outer perimeter of the lever 36 will provide a substantial mechanical advantage. When the user releases the string and fires an arrow from the drawned position, the cam 20 will rotate at a substantial speed counterclockwise as viewed in FIG. 5. The initial rotation of the cam 20 will cause the locking pin 58 to remain in the fully compressed position shown in FIG. 5. The force or pressure of the string will cause the lever 36 to immediately assume the first position as detent 52A will not be engaged by locking pin 58. Expressed in another way, the mechanical advantage that was realized by the lever assuming the second position will be lost as the lever now assumes the first position. This, of course, means that the shooting force will now exceed the draw force.

Locking mechanism 50 discussed above is but one example of a locking device that will permit the variable cam to assume two different configurations while the string 22 is being drawn and while the same string is exerting a shooting force on an arrow. There are other known locking devices that will perform the same function. Some of these locking devices are referred to as inertia locking devices and mechanically actuated locking devices. In any event, the locking device of the present invention is one that can be positioned in the locked position and which will be automatically released in response to string 22 being released and an arrow shot from the bow.

Figure 9:
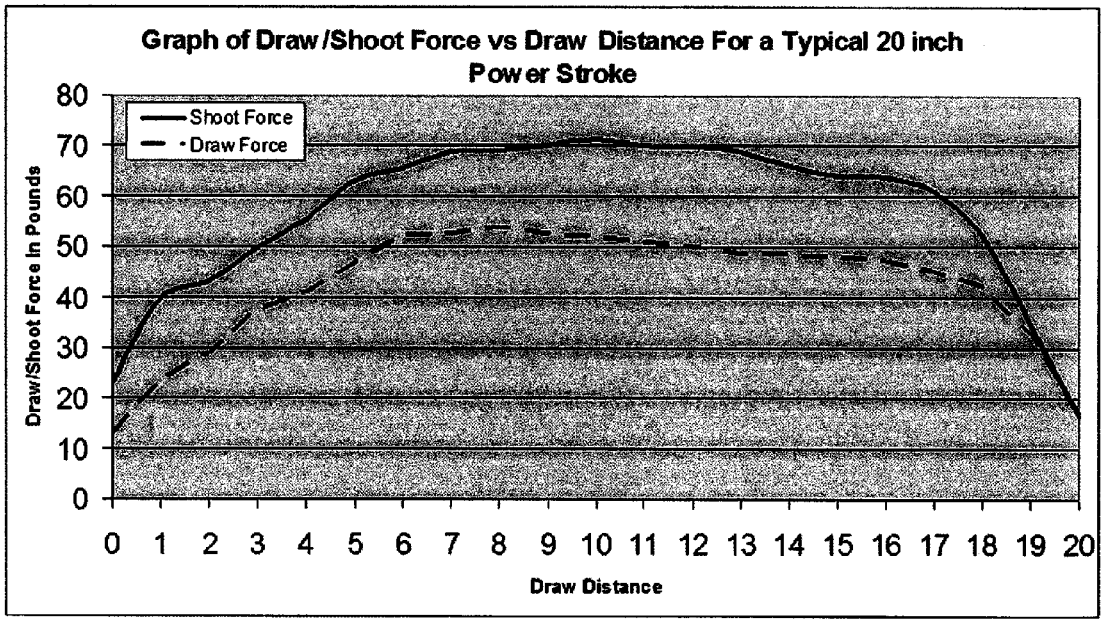
FIG. 9 is a graph comparing the draw and shooting force of the bow of the present invention.
Figure 10:
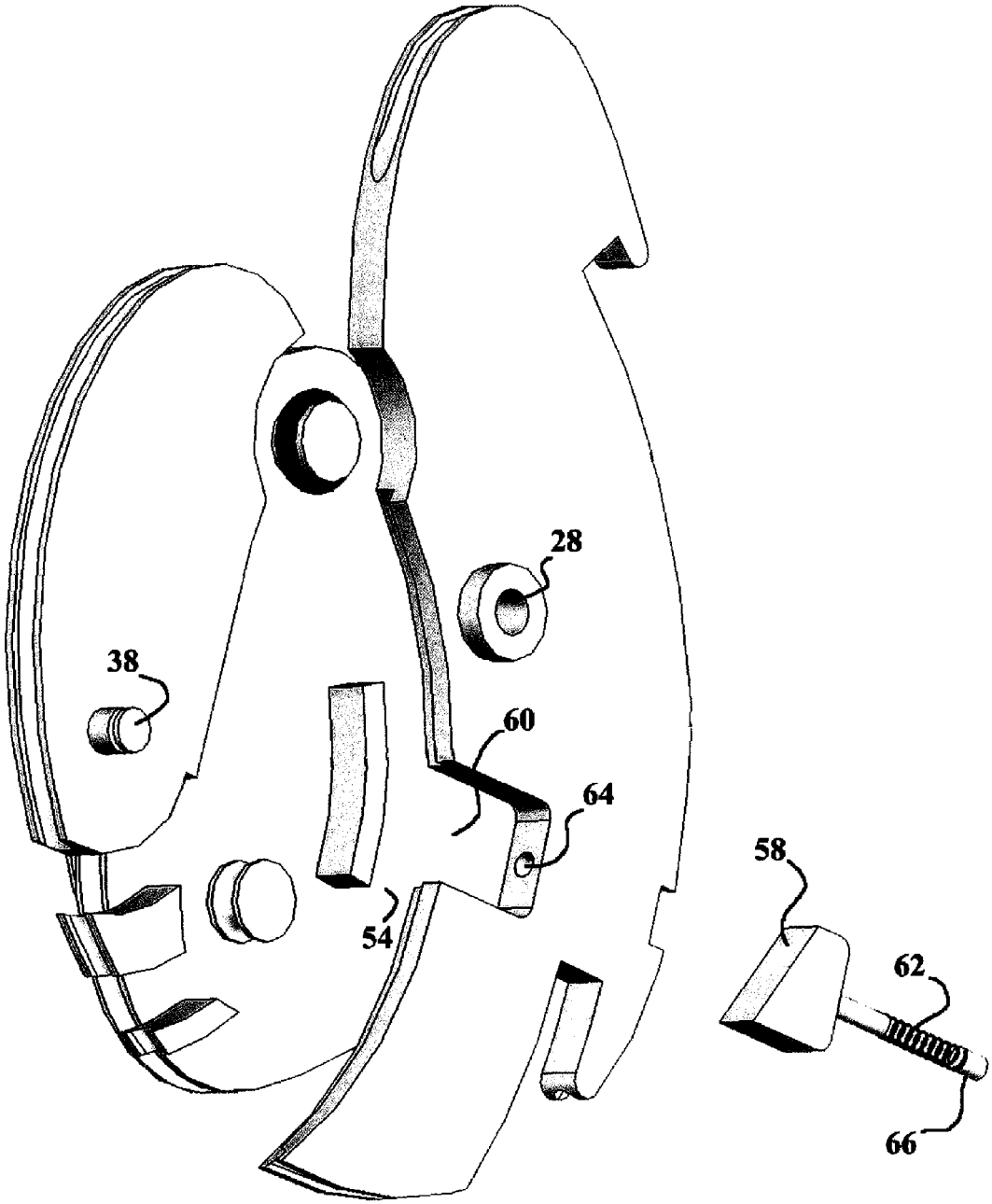
FIG. 10 is a perspective view of the "front" of the body of the cam assembly with the lever and the bow assembly removed for clarity
Figure 11:
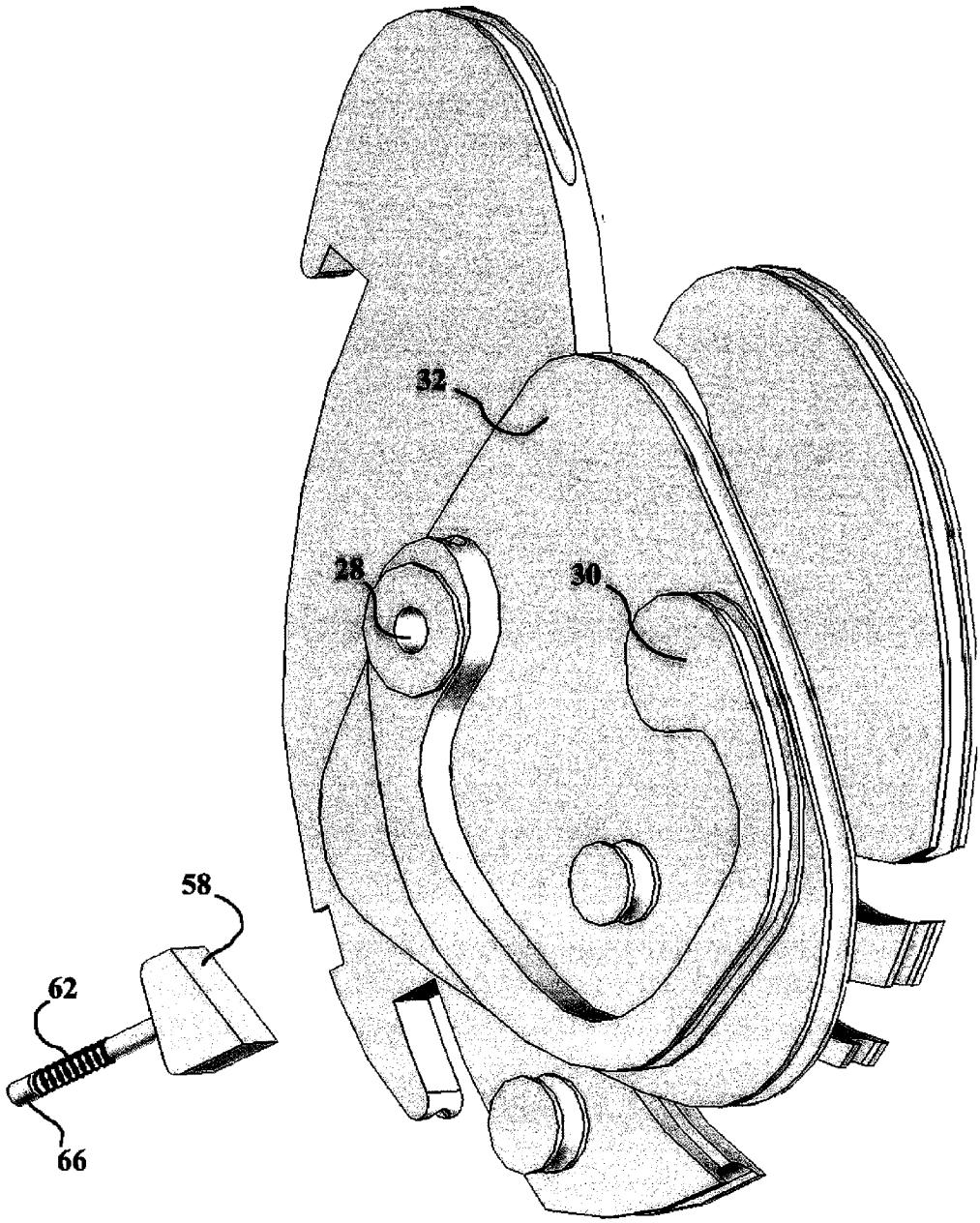
FIG. 11 is a perspective view of the "back" of the body of the cam assembly with the lever and the bow assembly removed for clarity
Figure 12:
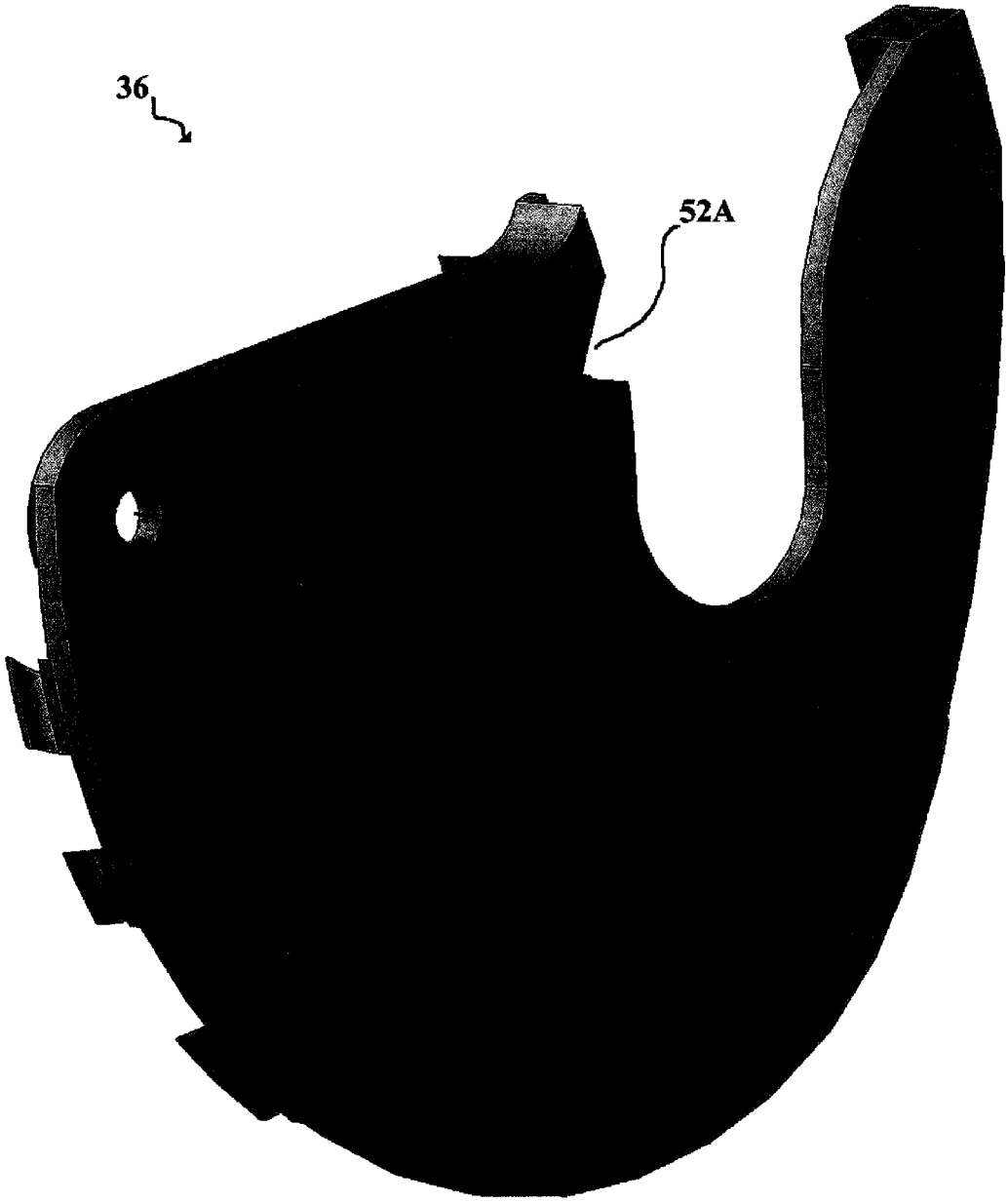
FIG. 12 is a perspective view of the "front" of the lever
Figure 13:
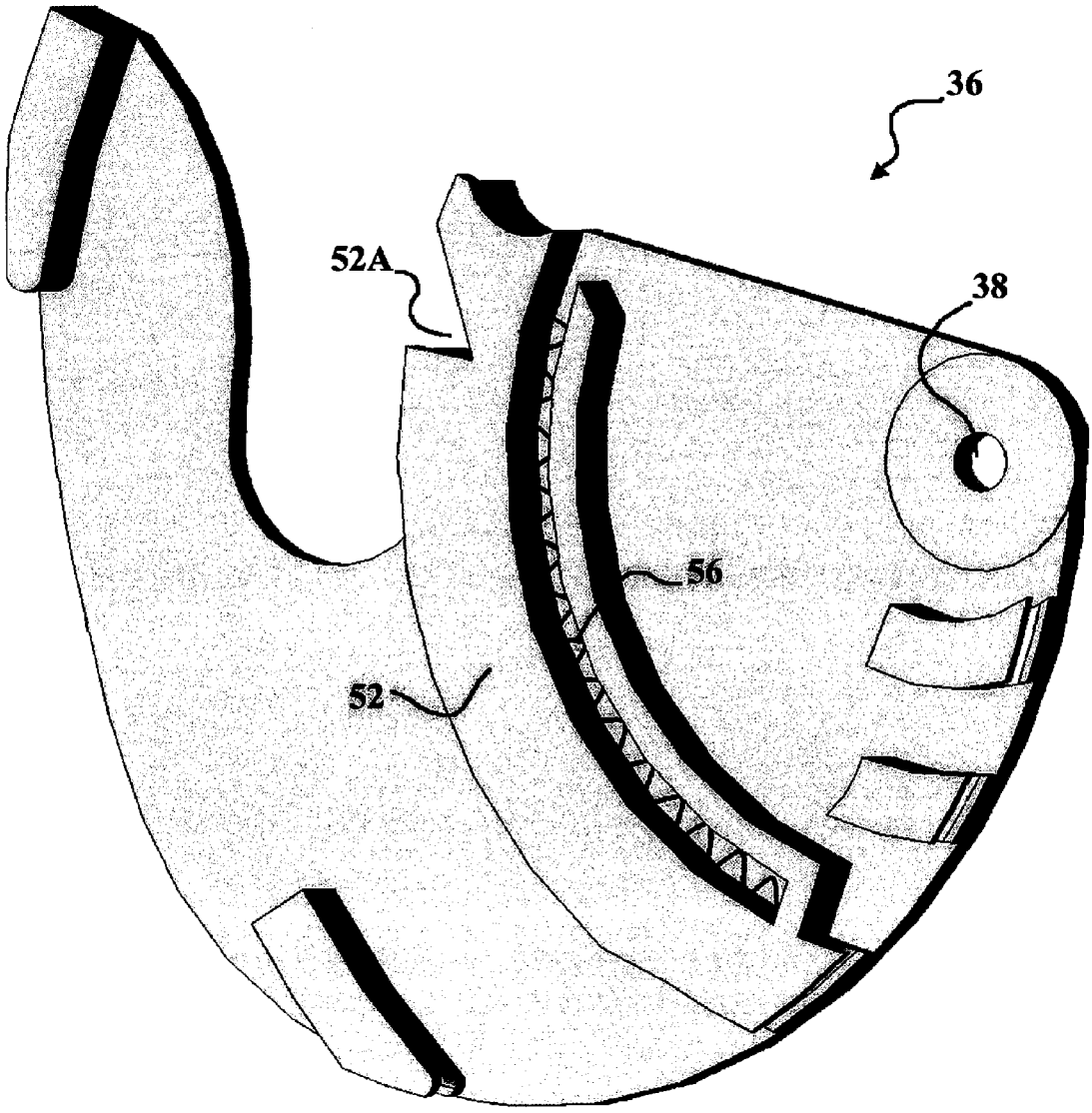
FIG. 13 is a perspective view of the "back" of the lever

With reference to FIG. 9, there is shown therein a drawing comparing the representative draw force to the shooting force. As seen therein, the draw force is substantially less than the shooting force.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A bow comprising: a frame; at least one variable cam; a string trained around at least a portion of the variable cam and adapted to be drawn and released; and wherein the cam includes a string track that varies between at least two different configurations in response to the phase of operation such that the draw force of the string is less than a shooting force of the string.

2. The bow of claim 1 wherein the string track is a part of a lever that moves between first and second positions.

3. The bow of claim 2 wherein the lever is pivotally mounted on the cam.

4. The bow of claim 3 including a lock that locks the lever in the second position but which is releasable in order that the lever may return to the first position.

5. The how of claim 1 wherein the cam includes a base structure and a movable structure that moves between at least first and second positions and wherein at least a portion of the string engaging segment is disposed on the movable structure; and wherein during one mode of operation the movable structure assumes the second position and wherein as the string is drawn the cam rotates and the string contacts at least a portion of the string engagement segment disposed on the movable structure while the movable structure assumes the second position; and wherein in the second mode of operation the movable structure assumes the first position and wherein when the string is released to fire an arrow at least a portion of the string will be engaged with the varied string path resulting from the movable structure assuming the first position.

6. The bow of claim 5 having a lock for locking the movable structure in the second position.

7. A bow for enabling the draw force to be less than the shooting force, comprising:

a. a frame;

b. a cam rotatably mounted to the bow and having a string track;

c. a string trained around at least a portion of the string track of the cam and operative to be pulled from an at rest position to a drawned position and released, resulting in the string imparting a shooting force to an arrow; and d. at least a portion of the string track of the cam assuming a first configuration when the string is being moved from the at rest position towards the drawned position and a second configuration after the string is released from the drawned position and moving back towards the at rest position.

8. The bow of claim 7 wherein the cam includes a movable member movable between first and second positions, and wherein at least a portion of the string track is disposed on the movable member.

9. The bow of claim 8 wherein the cam rotates about an axis and wherein the radius between a point on the string track and the axis varies as the movable member moves between the first and second positions.

10. The bow of claim 8 including a lock for locking the movable member in at least one position.

11. The bow of claim 10 wherein the lock is releasable in response to the string being drawn and released such that upon the lock being released the movable member returns to the first position.

12. A method of reducing the draw force of a how string relative to the shooting force of the bow string comprising:

a. engaging the bow string with a cam having a variable string track that is movable between at least two different configurations with respect to an axis of the cam;

b. wherein when the bow string is drawn from an at rest position to a drawned position the string track assumes a first configuration that yields a mechanical advantage;

c. wherein when the bow string is released from the drawned position and an arrow is shot and the string moves towards the at rest position the string track assumes a second configuration; and d. wherein the different configurations of the string track results in the draw force being less than the shooting force.

13. The method of claim 12 wherein the bow includes a locking mechanism and wherein the method includes locking the string track in the first configuration during at least a portion of the period when the bow string is being drawn from the rest position to the drawn position.

14. The method of claim 13 including releasing the locking mechanism when the bowstring is released from the drawn position and an arrow is shot.

15. The method of claim 14 including automatically releasing the locking mechanism when the bowstring is released from the drawn position and an arrow is shot.

16. The method of claim 13 wherein the locking mechanism automatically releases from a locked position in response to the bow string being released from the drawn position and an arrow is shot.

17. The method of claim 13 wherein the string track normally assumes the first configuration and wherein the string track is set and locked in the second configuration in response to the bow string being pulled towards the drawn position and slowly released to the at rest position.

18. The method of claim 13 wherein the cam includes a pivotally mounted lever and wherein at least a portion of the string track is disposed on the pivotally mounted lever.

19. A bow configured such that without the assistance of a second operator or a device to hold the bow in the drawn position the bow imparts a force on an arrow when shot that is greater than the force required to draw the bow and arrow to a shooting position.

* * * * *